US005669184A

United States Patent [19]

Anderson

[11] Patent Number: 5,669,184

[45] Date of Patent: Sep. 23, 1997

[54] SNOW BRACKET

[76] Inventor: Terry Elmer Anderson, 4544 W. Killarny Dr., Highland, Utah 84003

[21] Appl. No.: 684,170

[22] Filed: Jul. 19, 1996

[51] Int. Cl.[6] ..... E04D 13/10

[52] U.S. Cl. ..... 52/26; 52/24; 52/741.3; 52/749.12

[58] Field of Search ..... 52/24, 26, 712, 52/74.13, 749.12

[56] References Cited

U.S. PATENT DOCUMENTS

| | | | |
|---|---|---|---|
| 185,137 | 12/1876 | Rogers | 52/24 |
| 302,429 | 7/1884 | Rogers | 52/24 |
| 401,202 | 4/1889 | O'Gara | 52/24 |
| 591,594 | 10/1897 | Esselen | 52/26 |
| 618,134 | 1/1899 | Russell | 52/26 |
| 623,988 | 5/1899 | Contant | 52/26 |
| 646,623 | 4/1900 | Hawthorne | 52/26 |
| 907,355 | 12/1908 | Histand | 52/26 |
| 1,222,953 | 4/1917 | Histand | 52/24 |
| 1,983,518 | 12/1934 | Buedel | 52/26 |

FOREIGN PATENT DOCUMENTS

| | | | |
|---|---|---|---|
| 3303306 | 9/1983 | Germany | 52/24 |
| 4009164 | 9/1991 | Germany | 52/24 |
| 214656 | 8/1989 | Japan | 52/24 |
| 67347 | 3/1914 | Switzerland | 52/26 |
| 377515 | 11/1960 | Switzerland | 52/26 |

*Primary Examiner*—Robert Canfield
*Attorney, Agent, or Firm*—James L. Sonntag

[57] ABSTRACT

A snow bracket is disclosed comprising an elongated body with a snow retention end and a roof attachment end. The snow retention end has a snow barrier means constructed and configured to inhibit sliding of snow from a roof to which the snow bracket is attached. The roof attachment end is bent into a barb with a point extending toward the snow retention end, the point adapted to be held in a roof batten to inhibit the tendency of forces of the snow load on the snow bracket to straighten out the end.

9 Claims, 2 Drawing Sheets

SNOW BRACKET

FIELD OF THE INVENTION

This invention relates generally to snow guards that are applied to a roof structure to inhibit the sliding of accumulated snow from the roof.

BACKGROUND OF THE INVENTION

It is well known in the art to apply brackets, stops, or fenders to a roof structure in order to prevent snow that has accumulated upon the roof from sliding from the roof. The construction of the roof brackets must not only be strong enough to hold the weight of the accumulated snow, which can be considerable, but also the bracket must not damage the roof either during installation of the bracket or while the bracket is in use holding the snow up on the roof.

One form of a roof bracket is disclosed in Swiss patent 305,362 to Adolph Huwiler (Huwiler). Huwiler discloses a snow bracket for use on tile roofs. The snow bracket comprises a base with a generally triangular snow retaining portion at one end and a means for attachment to the roof at the other end. The means for attachment to the roof is essentially a downwardly extending lip that hooks over a horizontal wooden roof batten used also to support the tiles on the roof. While this sort of bracket has been successful to a degree, a heavy snow load can flex or break the bracket or the tile under the bracket, causing it to fail. Any portion of the bracket is subject to failure, but a particular problem is the detachment of the snow bracket at its attachment point. The force from the snow load pulls down at the snow retention end, which tends to straighten out the attachment lip. Under a heavy load the lip will bend up and straighten, causing it to release from the roof batten and becoming detached from the roof. Other snow brackets, such as that disclosed in U.S. Pat. No. 625,144, similarly rely on hooks that hook over the upper end of a shingle or slate, but these brackets suffer from the same problems.

It has also been proposed generally to attach snow brackets by nails or spikes that are driven directly down to the roof batten or subroof. However, for tile roofs this is not completely satisfactory. The tiles of tile roofs are often supported upon narrow laterally extending battens that could be split or weakened by the nail of sufficient size to resist a snow load. It is also undesirable to drive spikes or nails into a subroof, as this may compromise the weather and water seal of the roof. In addition, it is difficult to install these brackets on a pre-installed roof, since the tiles must be removed to install the brackets.

Other retaining methods for attaching snow brackets are known in the art. For example in U.S. Pat. No. 185,137, the end of the bracket attached to the roof is provided with a hook for hooking on a nail that secures the shingle. U.S. Pat. No. 5,349,791 discloses a snow bracket that is adhesively attached to the surface of a smooth metal roof. These methods cannot be applied to tile roofs, as cement and ceramic tiles do not support nails and adhesives. In addition, these brackets still suffer from the problem of the snow tending to straighten out and destroy the attachment to the roof. In addition, many cannot be easily applied to a pre-installed roof.

OBJECTS OF THE INVENTION

It is, therefore, an object of the invention to provide a snow bracket that solves the above discussed problems with the prior art.

It is also an object of the invention to provide a tile bracket that can be securely applied to tile roofs and will not fail, particularly at its attachment point, under high snow loading.

It is also an object of the invention to provide a snow bracket that can be applied to tile roofs that have already been installed.

It is also an object of the present invention to provide a snow bracket that can be applied to pre-installed tile roofs in a manner that does not require removal of the roof or will in any form damage the roof.

Further objects of the invention will become evident in the description below.

SUMMARY OF THE INVENTION

An embodiment of the present invention is a tile roof snow bracket that comprises an elongated body with a retaining end and an attachment end. At the retaining end, there is a snow retainer or fender, preferably in a generally rectangular configuration, is designed to block or inhibit the sliding of snow off the roof. The means for attaching the bracket to a roof comprises a spike or barb extending back toward the snow retention end. The barb is preferably on an axis generally parallel to and under the body of the bracket. The barb is preferably attached to the holder by a generally perpendicular holding member spanning the distance between the body and barb member. The distance between the body and barb is less than the thickness of the battens of the roof to which the snow bracket is to be applied. In use, the body of the snow bracket extends over the underlying tile with the retaining member beyond the top of the tile with the barb extending underneath the tile and directly into the wood of the batten supporting the tile. The force from the snow load that would tend to bend out the barb is countered by the retention of the hook into the wood batten. Accordingly, the snow bracket is capable of retaining higher snow loadings.

Another advantage of the present invention is its relative simplicity of manufacture. The body, the retaining member and the hook do not require separate fabrication. The whole unit can be stamped and bent from a single flat piece of metal. The members can be stiffened and strengthened by applying ribs during the stamping operation, enabling fabrication from relatively thin gauges of metal.

The attachment end also preferably comprises a follower with an axis generally parallel to the body but below both the axis of the hook and the body and with the follower extending in a direction opposite of the spike. The purpose of the follower is to ease installation of the bracket on a pre-existing tile roof. To install the bracket, the lower end of the tile is lifted up a small amount just enough to allow insertion of the bracket underneath the tile. The follower then provides a guide along the surface of the tile as when slides the bracket back underneath the overlaying tile and the subroof. Thus, the barb is prevented from damaging the surface of the tile or tearing or cutting the subroofing material.

The snow retention end comprises any suitable construction for inhibiting the slide of the snow off the roof for purposes of low cost and simplicity in manufacturing. The preferred snow retention means is a generally upstanding rectangular member. The rectangular member is reinforced by a diagonal member that extends from its top to a base collinear with the bracket body. The generally triangular configuration of the rectangular snow retention member, the diagonal member and the base member can be bent from the same metal strip that comprises the base of the bracket. The strip is bent to provide an upwardly extending snow fender and then down at an angle to provide a triangular strengthening bracket and then bent again back along the axis of the base and attached to the base by any suitable means such as bent metal pads cut from the metal strip or rivets or any other suitable method.

The snow bracket invention also comprises suitable ribs and like to stiffen the various components of the bracket. For example, stiffening ribs along the body can be stamped into the metal strip to prevent bowing or flexure of the body under a snow load. In addition, at the juncture of the retaining member with the body and at the juncture with the hook an indented gusset is provided to provide strength at those joints and to inhibit bending under a snow load.

The brackets of the present invention are designed for use on tile roofs, e.g., roofs with ceramic, fired-clay, or cement tiles supported on horizontal battens. However, use on other roofs is also contemplated where the snow guard can be secured to a horizontal batten or like structure as described in the claims.

DETAILED DESCRIPTION OF THE INVENTION

Figure 1:
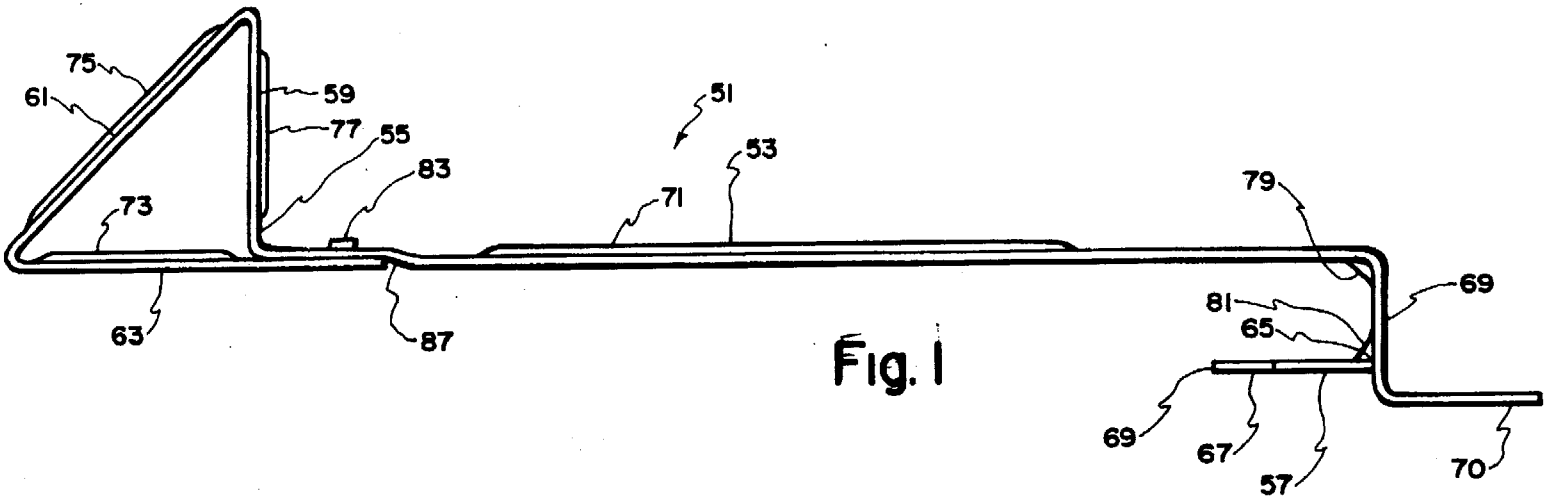
FIG. 1 is a side view of a snow bracket of the invention.
Figure 2:
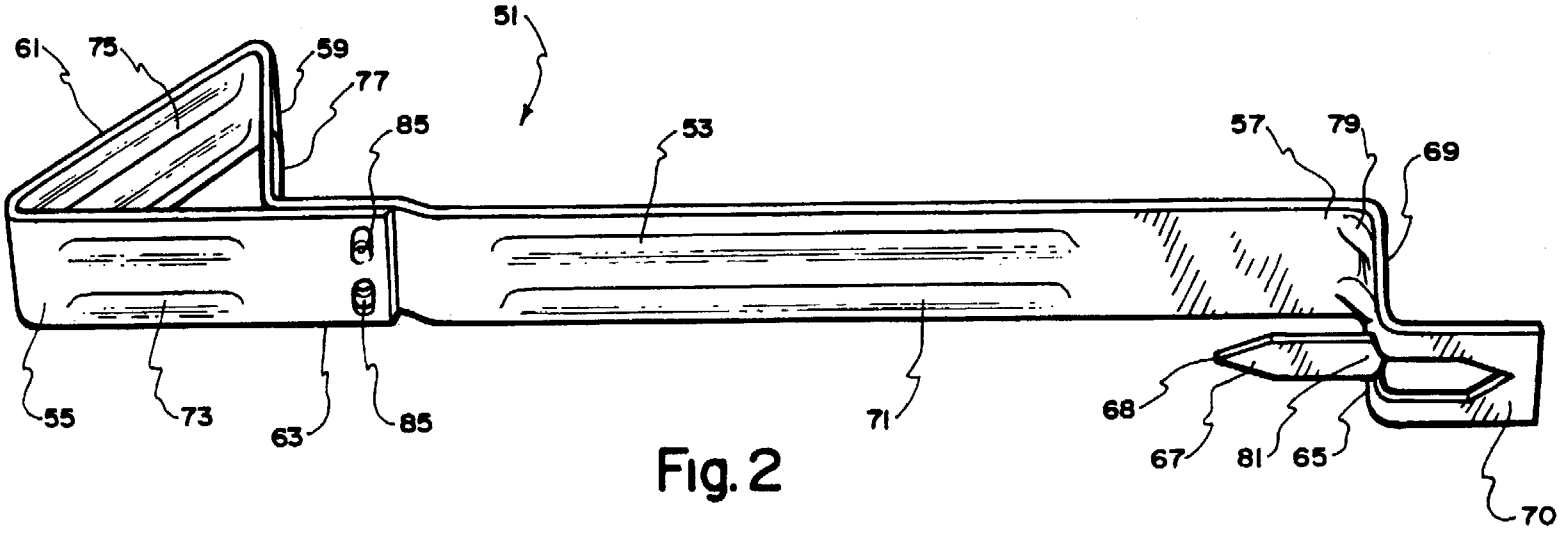
FIG. 2 is a perspective view viewing the snow bracket of FIG. 1 from the under side.
Figure 3:
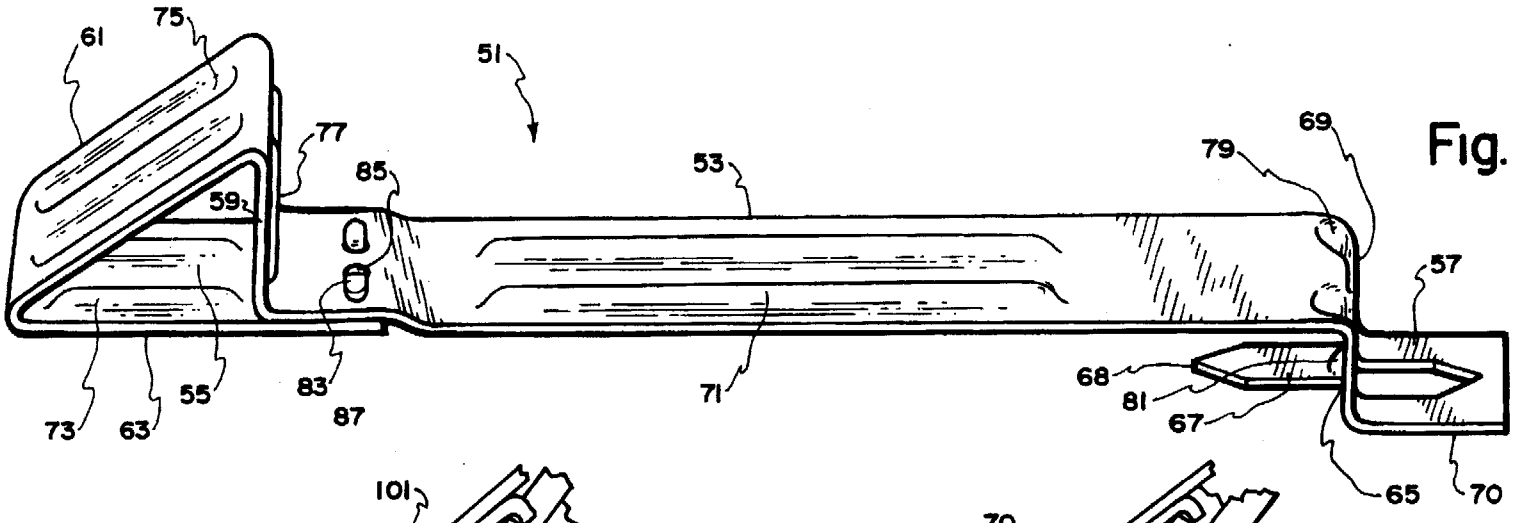
FIG. 3 is a perspective view viewing the snow bracket of FIG. 1 from the top side.

Referring to FIGS. 1, 2, and 3, the snow bracket of the invention, generally designated 51, comprises an elongated body 53 with a snow retention end 55 and a roof attachment end 57. The elongated body 53, is generally flat and strap-like, to permit its passage between roof tiles, as further explained below. At or near the snow retention end 55 is an upwardly extending snow dam or barrier member 59 that functions to prevent snow sliding from a roof upon which the snow bracket is installed. In the illustrated embodiment, the barrier member 59 extends upwardly and perpendicularly from the elongated body 53 to present a surface against the sliding of snow. A diagonal brace member 61 extends from the top of the barrier member 59 to a base member that is essentially a collinear extension of the elongated body at the snow retention end 55.

At the roof attachment end a barb 67, or pointed projection, below the elongated body 53 extends in a direction generally parallel to the elongated body 53 and back toward the snow retention end 55. The barb 67 is attached to the elongated body by means of an attachment member 69 that extends downward from the body 53 to span the distance to the root 65 of the barb 67. The attachment member 69 continues and extends further below the axis of the barb and merges into a follower 70 that extends on an axis generally parallel to the long axis of the elongated body in a direction away from the snow retention end 55, which is opposite the direction to which the barb 67 extends.

The snow bracket of the invention is preferably constructed from a single piece in the form of a long, narrow strip. The strip is preferably of a suitable sheet metal, such as steel, galvanized steel, or any other suitable sheet material with suitable rust and corrosion resistance, with the suitable strength required to retain snow upon the roof, and with suitable malleability to enable formation of the show bracket by bending.

To stiffen the bracket member stiffening ribs that extend along the long axis of the members are provided. These include ribs in the elongated body 71, the bottom member 73, the diagonal member 75, and the snow retention member 77. In addition, a gusset or gussets 79 are provided at the joinder of the elongated body and the attachment member. A gusset or gussets are also provided at the root 65 of the barb 67 where the barb 67 attaches to the attachment member 69. The gussets 79 and 81 inhibit rotation of the attachment member 69 and the barb 67 about their attachment points. This rotation would otherwise occur under a stress from a snow load. This is basically a tensile stress along the elongated body that would tend to pull the attachment member, and the barb straight with the elongated member.

The snow bracket 51 is manufactured by bending the sheet metal strip at the appropriate places to form the shape illustrated in the figures. The ribs 71, 73, 75, 77 may be applied form by known methods, such as stamping, or the like. At the snow retention end 55, after forming the triangle of the barrier 59, diagonal 61, and base members 63, the end of the strip is attached to the body 53 of the snow bracket by appropriate means such as by rivets, or by tabs 83 that are punched from the strip near the strip end and extended through holes 85 in the elongated body and bent over to hold the strip end to the elongated body 53, as illustrated. The elongated body is bent or indented slightly upward 87 to provide a more flat surface on the underside of the snow bracket 57.

The roof attachment end is likewise formed by bending the sheet metal strip at the appropriate positions. The barb 67 is formed from a cut-out at the end of the elongated strip of sheet metal. The cut-out barb is in a generally pointed configuration such that when the strip is bent for the attachment member 69 and the cutout bent out of the strip to form the barb 67 the barb extends back toward the snow retention on an axis generally parallel to the elongated body. At a position below the root of the barb, the strip is also bent to form a follower bending the attachment member 69 into the follower 70 at a point below the barb root 65 with the follower extending in a direction away from the snow retention end 55.

The cutting of the strips and the cutouts, the bending of the strip, and the forming of the reinforcing ribs may be accomplished in any order by any suitable means used in metal fabrication.

Figure 4:
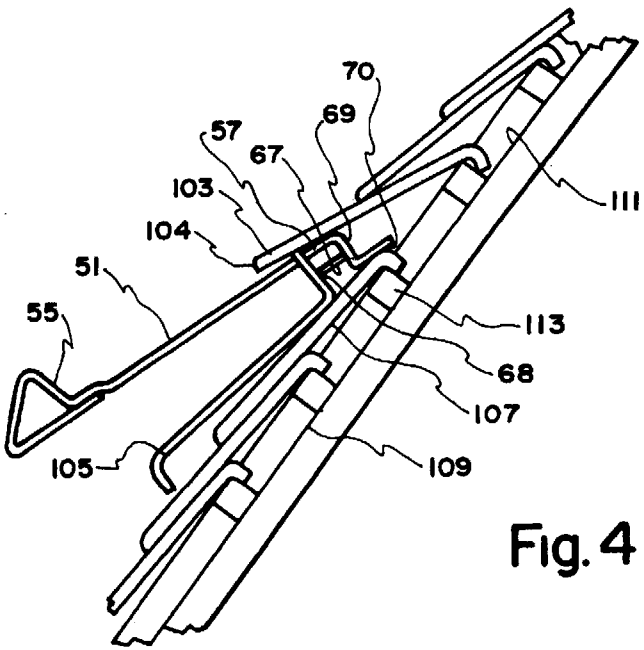
FIG. 4 is a cross sectional view of a snow bracket as in FIG. 1 showing its installation upon a tile roof.

The snow bracket may be installed upon a tile roof that is pre-existing, or it may be installed on a tile roof as it is being installed. Referring to FIG. 4, to install on a pre-existing tile roof 101, an overlying tile 103 is merely lifted at its downside unattached end 104 by hand or an appropriate tool 105 and the snow bracket 51 inserted between this overlying tile 103 and the tile 107 underlying the overlying tile. The follower 70 of the bracket guides the bracket between the tiles 103, 107 and prevents damage to the tile's surface and any subroof 109. Frequently the subroof 109 has a surface covered by roofing papers and the like, and to prevent the possibility of the barb damaging this surface during installation, the follower is disposed below the barb 67 to that it can slide along the subroof and maintain the barb point 68 a safe distance above the subroof.

The snow bracket 51 is pushed up underneath the overlying 103 tile to a position where the point 68 of the barb 67 is beyond the batten 113 that supports the underlying tile 107. The motion is then reversed, and the snow bracket is pulled in an outward or downward to force the point 68 of the barb 67 against the support batten 113 of the underlying tile 107. The point 68 of the barb 67 is at such a distance below the long axis of the body 53 of the snow bracket such that the barb point 68 contacts the batten 113 near its center on its backside. The body of the snow bracket is than laid upon the underlying tile 107 and the overlying tile 103 is then lowered into place over the underlying tile 107 and the body 53 of the snow bracket 51.

If the snow bracket is being installed during construction of the roof, the snow bracket is merely installed over an underlying tile before the overlying tile is installed. The snow bracket of the invention may also be installed on roofs with no sub-roof, in which case the snow bracket may be constructed with no follower.

Figure 5:
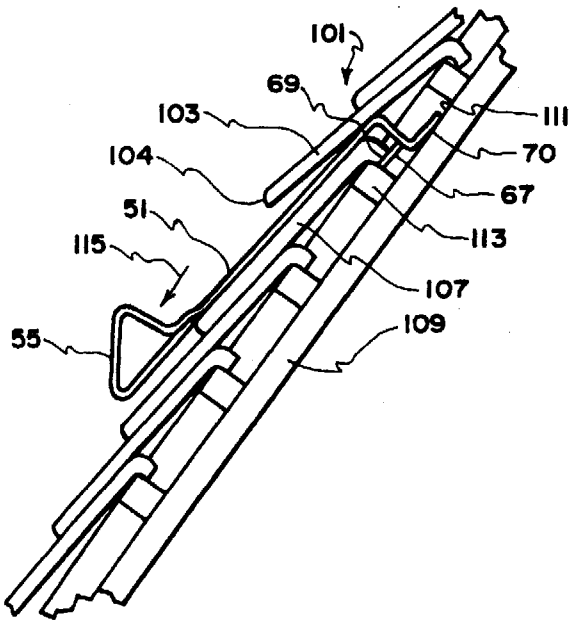
FIG. 5 is a perspective view of a tile roof showing the snow brackets of the invention installed upon the roof.

Referring to FIG. 5, when the snow bracket 51 is installed, the overlying tile extends over a portion of the elongated body with the snow barrier member 59 extending up above the roof 101 so that it can retain snow upon the roof. When a force from a snow load is applied to the snow bracket, as shown by the arrow 115, rather than bending out the snow bracket, the point of the barb 68 is held into the batten 113 by the force. Because the barb 67 is fixed or retained in the batten by means of its sharp end 68 sticking into the support batten, the snow bracket is prevented from bending and straightening out such that the attachment to the roof fails. Without a pointed barb extending into the batten, a snow bracket would tend to straighten out, would allow the snow bracket to slide out from between the overlying and underlying tiles. This is what may happen with prior art snow brackets under heavy snow loads, as, for example, the Huwiler bracket discussed above. When a load is applied to such a snow bracket, the retaining at the batten hook will tend to straighten out, and the snow bracket will fail. However, with the snow brackets of the invention, an increased force of the snow load, rather than straightening out the snow bracket, tends to increase the strength of the attachment to the batten by forcing the barb point further into the batten. This discourages detachment of the barb from the batten and opposes the tendency to bend the barb, the attachment member, and the body in a manner that would rotate these members about their points of joinder. The barb construction the present invention inhibits this bending, so for the snow bracket of the invention to fail, it must be either by failure of the snow retention end or breakage or a deformation of the elongated body of the bracket or other member of the snow bracket. In tests between snow brackets of the invention and comparative brackets where the snow retention end merely wrapped around the support batten, the failure of the snow bracket of the invention occurred at loads at about 110 lbf and above, which is well above the load of failure for a comparative bracket without the barb feature of the invention, which failed at about 65 lbf. The load was a simulated slow load created by applying a force to the snow barrier member.

The dimensions of the snow bracket are those appropriate for the tile size of the roof, for retaining snow upon the roof and for the snow bracket to function as herein described and claimed. In an actual application, the brackets are about 26½ inches and 28 inches long. The length is preferably chosen such that the snow retention fender overlies a section of the underlying tile that is directly over a roof batten, so the downward force of a snow load in the retention fender will not break the tile. The axis of the barb is approximately 1 to 1½ below the axis of the body, and the axis of the follower between about ¼ and ⅓ inches below the axis of the barb. The snow barrier is approximately 3 inches high in the form of a right isosceles triangle.

The snow retention means illustrated in FIGS. 1 to 3 is preferred because of its ease of manufacture from an elongated piece of sheet metal. However, other snow retention means at the snow retention end may also be applied to the snow bracket of the invention without departing from the scope of the claims. In addition, the snow bracket may be manufactured by other suitable means, such as casting from metal, or molding from a suitable high-strength polymeric material, or assembling from parts of dissimilar materials.

While this invention has been described with reference to certain specific embodiments and examples, it will be recognized by those skilled in the art that many variations are possible without departing from the scope and spirit of this invention, and that the invention, as described by the claims, is intended to cover all changes and modifications of the invention which do not depart from the spirit of the invention.

What is claimed is:

1. A snow bracket for tile roofs comprising an elongated body with a snow retention end and a roof attachment end, the snow retention end having a snow barrier means constructed and configured to inhibit sliding of snow from a roof to which the snow bracket is attached, the roof attachment end comprising an attachment member extending downwardly and generally perpendicular to the elongated body, and a barb in the form a pointed projection attached to the attachment member on an axis generally parallel to the elongated body with a point extending toward the snow retention end and adapted to be held in a roof batten upon which an underlying tile of the roof is supported.

2. The snow bracket of claim 1 wherein the roof attachment end comprises a follower to prevent contact of the barb with a subroof during installation of the snow bracket.

3. The snow bracket of claim 2 wherein the attachment member extends below the axis of the barb and merges into the follower, which extends in a generally parallel axis to the elongated body in a direction away from the snow retention end.

4. The snow bracket of claim 1 wherein the snow retention end comprises a generally triangular member comprising a vertical snow barrier member extending up from a lower end from the snow retention end of the elongated body, a base member extending generally collinearly with the elongated member from the lower end, and a diagonal member extending from the upper end of the barrier member to the base member to inhibit deformation of the snow retention mean when under a snow load.

5. A snow bracket for tile roofs comprising an elongated body with a snow retention end and a roof attachment end, the elongated body in the form of an elongated strip extending along a longitudinal axis and dimensioned to pass between an overlying tile and an underlying tile of a roof, the snow retention end having a snow barrier member, a base member, and a diagonal member joined in a generally triangular configuration with the barrier member extending generally perpendicular and upward from the elongated body and the base member and the diagonal member extending from the top of the barrier member to the base member with the barrier member presenting a snow retention surface, the roof attachment end comprising an attachment member extending downwardly and generally perpendicular to the elongated body, a barb in the form a pointed projection attached to the attachment member on an axis generally parallel to the longitudinal axis with the point extending toward the snow retention end and adapted to be held in a roof batten supporting the underlying tile.

6. The snow bracket of claim 5 wherein the snow bracket is formed from an elongated strip of metal.

7. The snow bracket of claim 6 wherein the pointed projection is formed as a cut out on the elongated metal strip and is attached to the attachment member at a root wherein the projection is bent at the root to extend the point of the projection toward the snow retention end.

8. The snow bracket of claim 7 wherein the attachment member extends below the root and merges into a follower that extend generally parallel to the axis of the elongated body in a direction away from the snow retention end.

9. A method for attaching a snow bracket having an elongated body to a tile roof comprising lifting a downward free end of an overlying tile that is overlying an underlying tile, inserting a roof retention end of a snow bracket between the tiles, hooking a pointed barb that extends from the roof attachment end with a point extending toward a snow retention end onto a batten supporting the underlying tile, such that the point of the barb contacts the batten and penetrates the batten surface, the roof attachment end comprising an attachment member extending downwardly and generally perpendicular to the elongated body, the barb in the form a pointed projection attached to the attachment member on an axis generally parallel to the elongated body with the point extending toward the snow retention end, lowering the downward end of the overlying tile.

* * * * *